United States Patent [19]

Jukes et al.

[11] 4,256,807

[45] Mar. 17, 1981

[54] SYNTHETIC LATEX MODIFIED PULP INSULATED CONDUCTORS

[75] Inventors: John A. Jukes, Hough, England; Thomas C. Pound, Hudson; Wayne A. Cascarano, Otterburn Park, both of Canada

[73] Assignee: Northern Telecom Limited, Montreal, Canada

[21] Appl. No.: 69,069

[22] Filed: Aug. 23, 1979

Related U.S. Application Data

[60] Continuation-in-part of Ser. No. 926,309, Jul. 20, 1978, abandoned, which is a division of Ser. No. 617,324, Sep. 29, 1975, Pat. No. 4,125,645.

[51] Int. Cl.[3] ..... D02G 3/00; H01B 7/02

[52] U.S. Cl. ..... 428/379; 162/164 R; 162/168 N; 162/168 R; 162/169; 174/124 R

[58] Field of Search ..... 428/379, 375; 174/124 R; 162/168 R, 168 N, 169, 164 R, 106

[56] References Cited

U.S. PATENT DOCUMENTS

| | | | |
|---|---|---|---|
| 2,563,897 | 8/1951 | Wilson et al. | 162/168 R X |
| 2,601,597 | 6/1952 | Daniel, Jr. et al. | 162/168 R |
| 2,601,598 | 6/1952 | Daniel, Jr. et al. | 162/168 R |
| 3,409,500 | 11/1968 | Strazdins et al. | 162/168 N X |
| 3,480,725 | 11/1969 | Mildner | 174/124 R |
| 3,597,311 | 8/1971 | Jachimowicz et al. | 174/124 R X |
| 3,766,002 | 10/1973 | Greif et al. | 162/168 R |
| 3,776,812 | 12/1973 | Jongetes | 162/168 R |
| 3,902,958 | 9/1975 | Breen et al. | 162/168 R X |

FOREIGN PATENT DOCUMENTS

| | | | |
|---|---|---|---|
| 1401931 | 8/1975 | United Kingdom | 174/124 R |

*Primary Examiner*—Lorraine T. Kendell
*Attorney, Agent, or Firm*—Sidney T. Jelly

[57] ABSTRACT

A pulp insulated electric communications conductor in which the wood pulp fibers of the insulation are coated with an aqueous based cationic deposition aid polymer and then an aqueous based anionic latex polymer. In a process for applying a layer of insulating material to the conductor a slurry of wood pulp fibers is prepared to which first an aqueous based cationic deposition aid polymer is added and then an aqueous based anionic latex polymer is added, the resultant coated wood pulp fibers being applied to the conductor.

9 Claims, 1 Drawing Figure

SYNTHETIC LATEX MODIFIED PULP INSULATED CONDUCTORS

Figure 1:
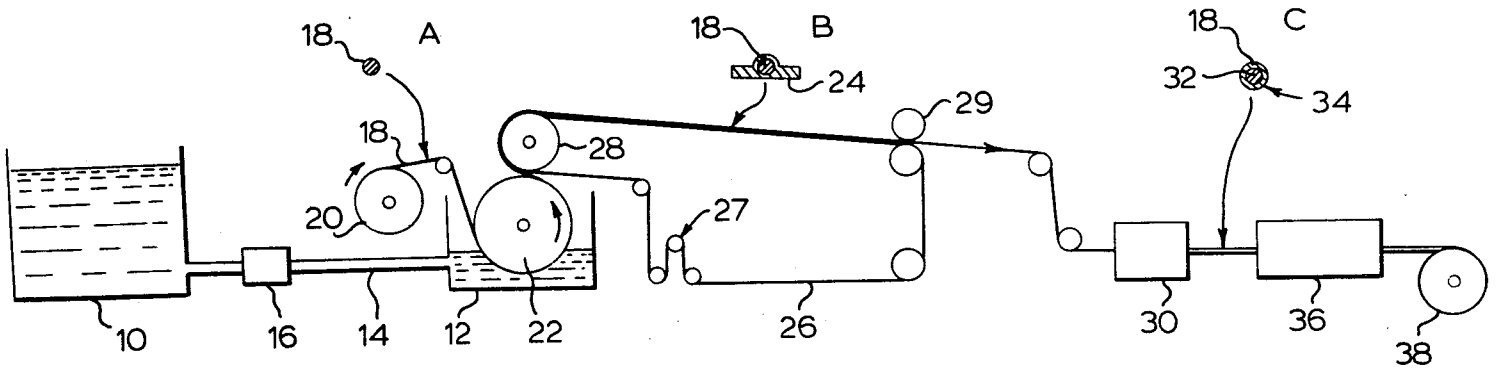

This invention relates to insulated electrical communications conductors and more particularly to an improved insulation for such conductors. This application is a continuation-in-part of application Ser. No. 926,309, filed July 20, 1978, now abandoned; which was a divisional of application Ser. No. 617,324 filed Sept. 29, 1975 and now U.S. Pat. No. 4,125,645.

Sheathed electrical cables carrying a number of pairs of individual insulated conductors are frequently installed underground in ducts. With increasing demand in the field of communications such ducts are becoming congested and any reduction in the thickness of the insulation over the conductors would be advantageous to reduce the overall diameter of the cable. An insulation commonly used on communications conductors is wood pulp and it is difficult to reduce the thickness of the wood pulp layer without reducing its dielectric properties, and its mechanical strength, to an unacceptable level.

It is an object of this invention to provide a modified wood pulp insulation material for a communications conductor which will allow a reduction in the thickness of the insulation.

In its broadest aspect the invention consists of a process for insulating an electric wire conductor comprising the steps, in sequence, of: preparing a slurry of wood pulp fibers, adding to the slurry a solution of an aqueous based cationic deposition aid polymer; adding to the slurry containing the wood pulp and the deposition aid polymer an anionic latex to coat said fibers; applying the coated wood pulp fibers to the conductors to form an insulative coating thereon.

In another aspect the invention consists of an electric wire conductor having an insulation of wood pulp, the fibers of the pulp having an inner coating of an aqueous based cationic deposition aid polymer and an outer coating of an aqueous based anionic latex polymer, both layers being devoid of a polyvalent metal salt. The avoidance of a polyvalent salt is essential as its presence would detract from the dielectric constant and dissipation factor of the insulation. Preferably, the latex is about 15% by weight of the wood pulp fibers.

An example embodiment of the invention is shown in the accompanying drawings in which:

FIG. 1 is a schematic flow diagram of the application of latex modified pulp insulation to a wire conductor.

In the process according to the invention a slurry of wood pulp fibers is prepared and a deposition aid solution consisting of a cationic (positively charged) polymer is added to the slurry. The deposition aid polymer chemically bonds to the pulp fibers, to provide an inner coat which modifies the surface charge of the fibers from negative to positive. Next an anionic (negatively charged) latex is added to the slurry and adheres to the inner coat to provide an outer coat. The use of polyvalent metal salt is avoided during the whole process. The resultant modified pulp stock is fed into a pulp vat for coating a continuous wire conductor in known manner.

In the schematic diagram of FIG. 1 the modified pulp stock is prepared in a stock tank 10 and fed into a pulp vat 12 through a conduit 14, the flow being regulated by a control valve 16. A continuous strand of bare metal wire 18 as shown in cross-section A is unwound from a supply spool 20 into pulp vat 12 where the strand passes around a cylinder mold 22 partially submerged in the liquid modified pulp stock. The modified pulp fibers are deposited on wire 18 and on the screen of mold 22, and wire 18 emerges from the vat embedded in a strip coating 24 of modified pulp insulation as shown in cross-section B. A continuously moving felt band 26, adjusted by tension rolls 27 and passing around a main guide roll 28 adjacent cylinder mold 22, picks coated wire 18 from mold 22 and carries the coated wire to a pair of press rolls 29 for dewatering. Coated wire 18 then passes through a polisher 30 which wraps the lateral portions of strip coating 24 spirally around the wire to form an annular layer of insulation 32, thus producing an insulated wire strand 34 as shown in cross-section C. From polisher 30 insulated wire strand 34 passes through a drying oven 36 and then onto a take-up spool 38.

An example of wood pulp suitable for the purpose of the invention is sulfate soft wood pulp having the following properties:

| | |
|---|---|
| Alpha Cellulose content: | 83% min. |
| Alpha Cellulose + lignin content: | 88.5% min. |
| Aqueous Extract conductivity: | 45 μS max. |
| Canadian Standard Freeness: | 480 ml (after refining) |
| Fiber classification results: | (after refining) |
| % retained on 10 mesh: | 34% |
| 14 mesh: | 23% |
| 28 mesh: | 20% |
| 48 mesh: | 11% |
| % passing on 48 mesh: | 12% |

Aqueous based anionic latices and cationic deposition aids are suitable for use in the invention. Examples of suitable combinations of latices and deposition aids are:

(1) an anionic acrylic latex sold by Rohm & Haas Corporation under the designation AC-61 and a cationic deposition aid in the form of quaternary amino acrylic ester polymer sold by Rohm & Haas Corporation under the designation ZR-181; and (2) an anionic styrene butadiene latex sold by Dow Chemical Corporation under the designation 816 and a cationic deposition aid in the form of polethylenimine sold by Dow Chemical Corporation under the designation Tydex-12.

The latex may be added to the slurry in an amount from about 1% to about 50 % by weight of the wood pulp fibers. The amount of deposition aid added to the slurry is dependent upon the amount of latex to be added. As an example, the amount of latex for optimum fold endurance of the insulation is about 15% while the tensile strength increases linearly with increased amounts of the latex, as seen in Table 1 below. Consequently in the example the preferred range of weight of the latex is 10%–30% with a corresponding weight range of the deposition aid of 0.3% to 1.0%.

Less insulation, modified by the latex, is applied to the conductor, as seen in Table II below. To maintain the required mutual capacitance between pairs of conductors the insulation is expanded and its density reduced. The expansion is effected by heating the insulation additionally in drying oven 36. The resultant diameter of a typical conductor insulated according to the invention results in the inclusion of 15% more of such conductors in a cable of given diameter.

TABLE I

| Batch | Percent By Weight Pulp | Deposition Aid | Latex | Fold Endurance | Tensile Strength Psi × $10^{-3}$ |
|---|---|---|---|---|---|
| A | 100 | — | — | 282 | 3.32 |
| B | 89.7 | 0.3 | 10.0 | 470 | 3.83 |
| C | 84.7 | 0.4 | 14.9 | 497 | 4.10 |
| D | 79.6 | 0.5 | 19.9 | 496 | 4.36 |
| E | 69.5 | 0.7 | 29.8 | 460 | 4.88 |

TABLE II

| | Regular Pulp | Pulp modified with 15% latex |
|---|---|---|
| Weight of pulp per foot of conductor (mg/foot) | 98 | 70 |
| Outside diameter (mils) | 45 | 42 |
| Density (gms/cm$^3$) | 0.46 | 0.40 |

What is claimed is:

1. An electric wire conductor having an insulation of expanded wood pulp, the fibers of the wood pulp surrounded by an inner coating of an aqueous based cationic deposition aid polymer and an outer coating of an aqueous based anionic latex polymer, both layers being devoid of a polyvalent metal salt, to produce a dielectric constant comparable to a conventional non-coated pulp insulation of greater thickness.

2. A conductor according to claim 1, wherein the latex polymer is an anionic acrylic latex.

3. A conductor according to claim 1, wherein the latex polymer is an anionic styrene butadiene latex.

4. A conductor according to claim 1, wherein the latex polymer is between 1% and 50% by weight of the fibers and the deposition aid polymer is between 0.3% and 1.0% by weight of the fibers.

5. A conductor according to claim 1, wherein the latex polymer is approximately 15% by weight of the fibers and the deposition aid polymer is approximately 0.4% by weight of the fibers.

6. A conductor according to claim 1, wherein the deposition aid polymer is a quaternary amino acrylic ester.

7. A conductor according to claim 1, wherein the deposition aid polymer is polyethylenimine.

8. An electric wire conductor having an insulation of expanded wood pulp, the fibers of the wood pulp surrounded by an inner coating of an aqueous based cationic deposition aid polymer which is a quaternary amino acrylic ester polymer and an outer coating of an aqueous based anionic latex polymer which is an acrylic latex polymer, and both layers being devoid of a polyvalent metal salt to produce a dielectric constant comparable to a conventional non-coated pulp insulation of greater thickness.

9. An electric wire conductor having an insulation of expanded wood pulp, the fibers of the wood pulp surrounded by an inner coating of an aqueous based cationic deposition aid polymer which is polyethylenimine and an outer coating of an aqueous based anionic latex polymer which is a styrene butadiene latex polymer, and both layers being devoid of a polyvalent metal salt to produce a dielectric constant comparable to a conventional non-coated pulp insulation of greater thickness.

* * * * *